US005492065A

United States Patent [19]

Jena et al.

[11] Patent Number: 5,492,065

[45] Date of Patent: Feb. 20, 1996

[54] PLASTIC CARTRIDGE FOR A FIRING DEVICE, PARTICULARLY A BOLT GUN

[75] Inventors: Hans Jena, Fürth; Kurt Ballreich, Nürnberg, both of Germany

[73] Assignee: Dynamit Nobel Aktiengesellschaft, Troisdorf, Germany

[21] Appl. No.: 186,543

[22] Filed: Jan. 26, 1994

[30] Foreign Application Priority Data

Jan. 26, 1993 [DE] Germany ..... 43 01 967.6

[51] Int. Cl.[6] ..... C06D 5/00

[52] U.S. Cl. ..... 102/531; 89/35.01; 102/281; 102/466; 102/470; 227/9

[58] Field of Search ..... 102/281, 466, 102/467, 469–472, 530, 531; 227/9–11; 89/35.01

[56] References Cited

U.S. PATENT DOCUMENTS

| | | | |
|---|---|---|---|
| 4,819,562 | 4/1989 | Bowman | 102/281 |
| 4,920,885 | 5/1990 | Bowman et al. | 102/281 |
| 5,036,746 | 8/1991 | Ehmig et al. | 89/35.01 |
| 5,279,201 | 1/1994 | Jena et al. | 102/466 |

*Primary Examiner*—Harold J. Tudor

*Attorney, Agent, or Firm*—Antonelli, Terry, Stout & Kraus

[57] ABSTRACT

A plastics cartridge has a cartridge body provided with a flange which has a plastic casing body, open on one side, is for accommodating a propellent charge and an ignition charge for igniting the propellant charge and has a plastics cover for closing the open end of the casing body. A flange is located on the end of the casing body on the cover side. if the cartridge body is inserted into the firing device, the flange extends into a space which passes out of a receiving chamber of a cartridge recess and is formed by cartridge recess and bottom of the breech of the firing device. In the section in which it extends in the propagation direction of the pressure wave arising on ignition of the propellent charge, the flange of the cartridge body is tapered—in the propagation direction—at least over a part of said section. The flange therefore forms a wedge which is inserted into the wedge-shaped space between the cartridge recess and bottom of the breech. Stresses arising in the direction of the flange are transferred via the wedge to the cartridge recess and bottom of the breech and are reduced. Even with thermoplastic plastic extrusions of material in the flange region can be prevented by this tapered gap effect.

9 Claims, 5 Drawing Sheets

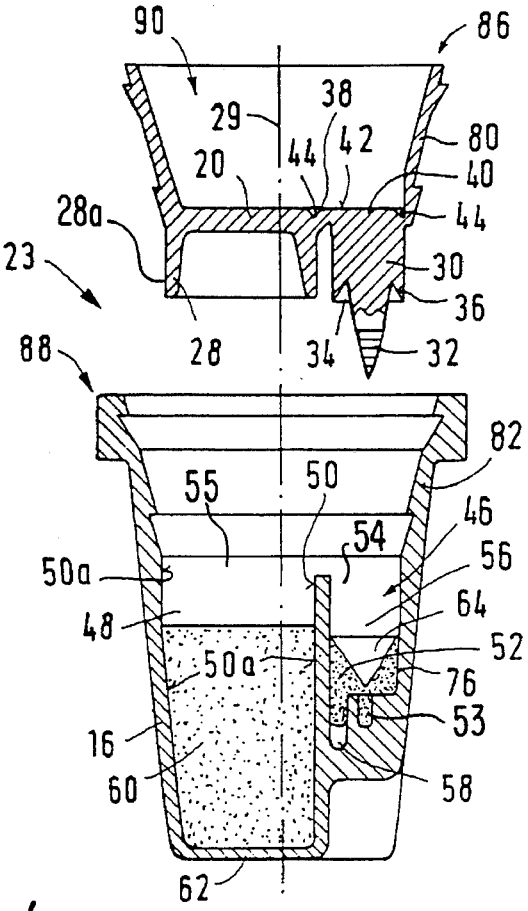
FIG. 3
FIG. 4
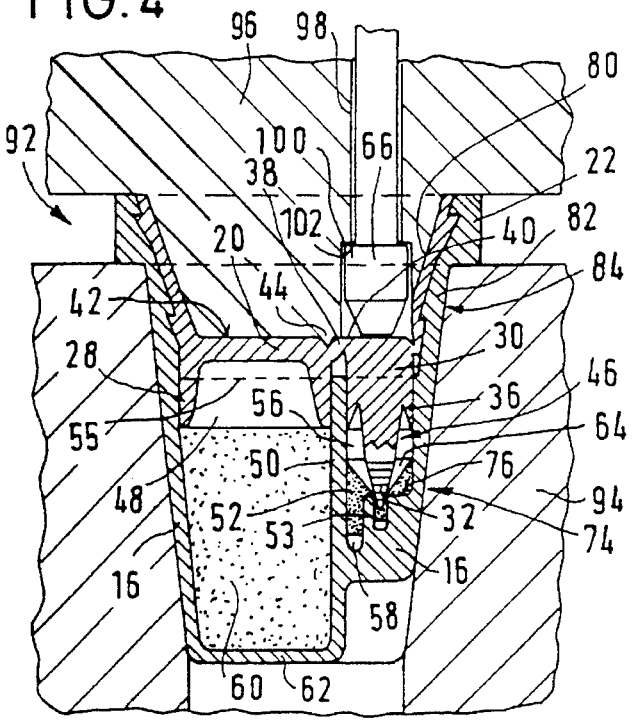
FIG. 5
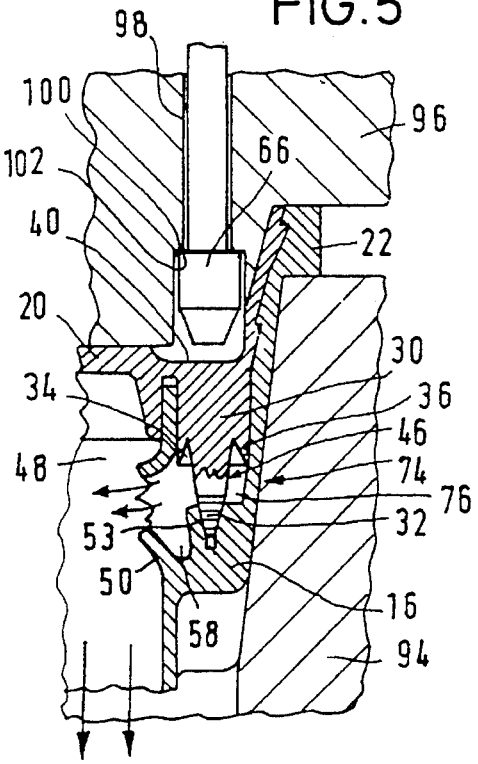

FIG.10
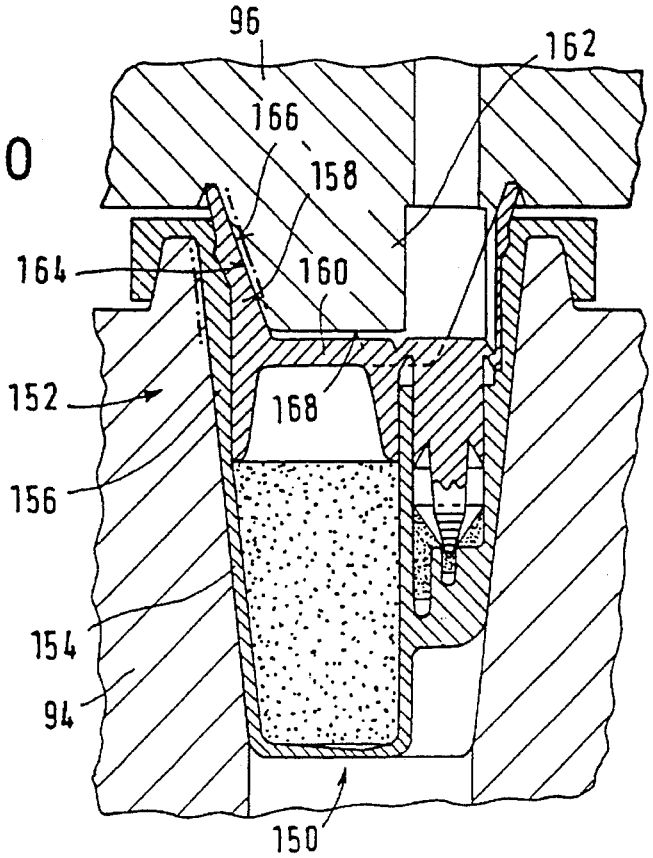
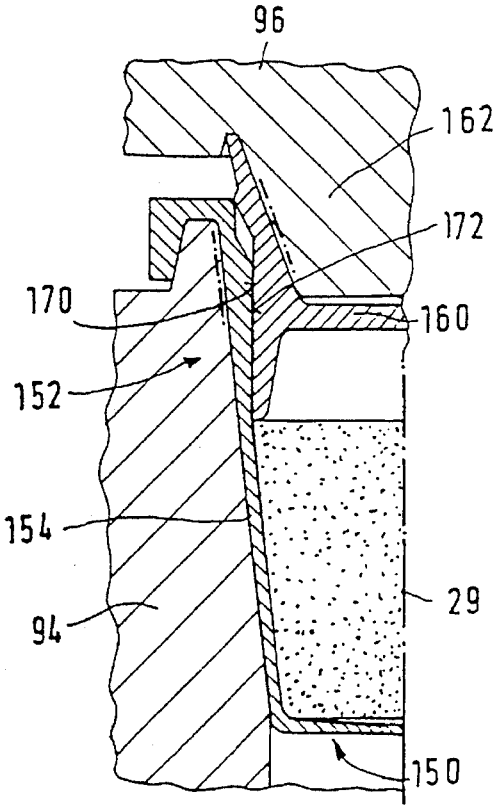
FIG.11

PLASTIC CARTRIDGE FOR A FIRING DEVICE, PARTICULARLY A BOLT GUN

FIELD OF THE INVENTION

The invention concerns a plastic cartridge for a firing device, particularly a bolt gun, the cartridge including a cartridge body having a flange, the cartridge body having a plastic casing body, open on one side, for accommodating a propellent charge and an ignition charge for igniting the propellent charge and a plastic cover for closing an open end of the casing body, with the flange being located on the end of the casing body on the cover side.

BACKGROUND OF THE INVENTION

Such plastic (propellant) cartridges are used in firing devices, particularly a wide range of bolt guns. In this respect, the cartridges are mostly integrated into magazine strips (cartridge belt magazine). However, plastic cartridges can also be used in centrally firing weapons. The advantages of plastic cartridges are, in particular, the relatively low material and manufacturing costs and the cartridges can be manufactured by injection moulding. The initially described plastic cartridge and the initially described plastic cartridge belt magazine respectively are shown in DE 37 79 24 Al.

Plastic materials have substantially lower strength than metal, for example. Thus, with plastic materials, the problem of the extrusion of material occurs on account of the gas pressures arising during the combustion of the propellent or powder charge. Extrusion of material can occur wherever the breech of the firing device accommodating the cartridge and therefore the space surrounded by the cartridge recess and bottom of the breech, is not closed. Firing devices operated by means of a cartridge magazine strip have, for example, a breech which is not closed since the magazine strip is, in the region of its cartridge, accommodated directly by the cartridge recess, and is passed out from the cartridge recess on two sides of the breech, and indeed via narrow spaces between the cartridge recess and the bottom of the breech. Furthermore, cartridges, particularly plastic cartridges with flanges or the like leading out of the cartridge recess are intended to be provided with extensions in order to be able to grip (manually or mechanically) the cartridge for removal from the cartridge recess after ignition of the charge. The problem of the extrusion of material also occurs, in particular, with those firing devices in which the front end of the firing barrel is placed on the surface into which the bolt is to be driven, and the cartridge recess is thus pressed against the bottom of the breech (when the breech is unlocked).

With such easy-to-handle devices, incorrect operation can cause the firing pin to be triggered when the cartridge recess is not fully pressed against the bottom of the breech or the magazine strip, with the result that the lateral spaces are larger than technically required by the device.

In order to prevent extrusion of material in the known plastic cartridges, the cartridge body is designed with thick walls at its end on the cover side and therefore at its end lying against the bottom of the breech. The use of simpler and less strong plastics for cartridges therefore makes thicker-walled cartridge bodies necessary, at least in certain regions; this is problematical, not just on account of the space available for introducing the powder charge.

SUMMARY OF THE INVENTION

The basic object of the present invention is to create a plastic cartridge for, in particular, firing devices such as bolt guns, for example, in which the plastic used must not have any significant strength for retaining the gas pressure.

In order to achieve this object, the invention proposes a plastic cartridge similar to that of the initially described type, but wherein the flange of the cartridge body, in the section in which it extends in the direction of spreading of the pressure wave arising during ignition of the propellent charge, tapers—in the propagation direction—at least over a part of said section.

With the plastic cartridge according to the invention, the thickness of the flange molded onto the cartridge body therefore tapers as the distance from the cartridge body increases, and indeed not necessarily over its entire length in the direction of the gas pressure, and thus in the direction of the maximum stress on the flange, but tapers at least in sections. Consequently, on the device side too, the space between the cartridge recess and bottom of the breech, in which the flange is located, is designed to taper outwards, in a wedge-shaped manner, at least in sections.

The invention is based on the finding that even plastic materials can be made to squeeze into a channel or space extending conically if a pressure is exerted on the end of greater cross-section (tapered gap principle for plastic materials). On account of the squeezing effect resulting from friction in the tapering channel, no material escapes from the end of smaller cross-section. Through the use of the tapered gap principle in the region of the flange of a plastic propellent charge cartridge extending between the cartridge recess and the bottom of the breech to reduce the squeezing in of the material, the flange tapering in the direction of propagation of the gas pressure wave, between the metal cartridge recess and the metal bottom of the breech, which, between them, form a tapering space or channel corresponding to the tapering flange, can accommodate the gas pressures arising during firing without the occurrence of extrusion of material. Thus, even low strength plastics can be used as the material for plastic cartridges, with no increase in the wall thickness being required in the flange region of the cartridge. Thus, with respect to their external dimensions, small format cartridges too still provide adequate receiving chambers for the powder charges (ignition and propellant charge). The thickness of the flange must simply be large enough that, in the case of magazined cartridges, a sufficiently strong connection of the cartridge to a magazine strip is present, or is possible, for removing the cartridge from the cartridge recess by gripping on the flange or magazine strip after firing.

In addition to the tapered gap effect, the wedge-shaped or conical limiting surfaces between the flange and the cartridge recess and the bottom of the breech also provide an extremely good external seal for reducing the pressure in the material, with preferentially rotationally symmetrical parts. This external seal is retained even if, as can occur with unlocked (mass) breeches in bolt guns, small breech openings are still present during firing.

In an advantageous further development of the invention it is provided that the flange of the cartridge body is formed, at least in sections, from a flange of the retaining body and a flange of the cover; the casing body and the cover flanges which lie against one another when the casing body is closed by the cover, form, at least partly, the tapering section of the cartridge body flange. At least one of the two flanges put together to form the cartridge body flange thereby extends, tapering, towards the outside. The tapered gap effect can moreover also be used to provide the gas-tight contact between the two flanges of the retaining body and cover. In the case of belt-magazined plastic cartridges, in which all the covers are integrated into a cover strip and all the casing bodies are integrated into a casing body strip, there is a risk that hot gases flow from the ignited cartridge located in the cartridge recess, via the space between the cover and casing body strips, into the adjacent, as yet unignited, cartridge and the powder charges can be initiated. To this end, discharge holes or recesses, for example, are provided in one of the two strips. These discharge holes or recesses are located in the connecting regions of the magazine strip between two cartridges. With the discharge holes or recesses, this therefore involves intentionally providing recesses via which the hot gases can flow out before they reach an as yet unignited cartridge. As a result of the use of the tapered gap effect to seal the flanges of the casing body and cover as well, the discharge recesses in the magazine strip may be omitted or may be smaller, which enables the magazine strip to be more stable and torsionally rigid, since weak spots in the material caused by recesses are smaller.

Preferably, the flange of the cartridge body extends at an acute angle to the longitudinal axis of the cartridge, beyond its end on the cover side of the cartridge. In this embodiment of the cartridge body, the flange therefore forms a kind of extension of the wall of the cartridge body; the cover is inserted comparatively deeply into the casing body; a relatively deep, conically tapering indentation is therefore formed at the end of the cartridge body on the cover side, this indentation being delimited by the (annular) flange of the cartridge body. Such a cartridge body necessitates a corresponding design on the part of the device, namely by providing the bottom of the breech with a projection corresponding to the indentation of the cartridge body at the end on the cover side. The advantage of the embodiment of the cartridge body described above is the creation of a comparatively long taper, which is formed by the flange. This results in a comparatively long path inside the tapered gap for reducing the pressure. Preferably, the tapering section of the flange extends at an angle of 5° to 20°, preferably at an angle of 10°, to the longitudinal axis of the cartridge body. As has already been described above, the flange is intended to close the space leading outwards, between the cartridge recess end the bottom of the breech when the cartridge body is inserted. The more this space or the flange extends parallel in the direction of movement of the cartridge recess or bottom of the breech, and thus the more it extends parallel in the direction of the longitudinal axis of the cartridge, the smaller the remaining free gap between the cartridge recess and flange or flange and bottom of the breech when the cartridge body is inserted and the cartridge recess is not fully closed. Ideally, the space between the cartridge recess and the bottom of the breech should extend in the direction of the longitudinal axis of the cartridge, since, in so doing, the space is constant, regardless of the breech opening. On the other hand, however, in order to remove the cartridge from the cartridge recess after firing, it is necessary that the cartridge recess be conical. The angles specified above for the flange (and thus also for the alignment of the space) of 5° to 15° or 20°, preferably 10°, represent a compromise between the two requirements.

Since it is not possible entirely to exclude breech openings in unlocked mass breeches, such as are used in bolt guns, the limiting surfaces of the cover and casing body flanges, in the region of the tapering wedge-shaped flange section of the cartridge body, should extend cylindrically or parallel to the longitudinal axis of the cartridge body. With breech openings, the distance between the cartridge recess and bottom of the breech is (briefly) increased at the instant of ignition of the cartridge and also during correct handling of the bolt gun; during this phase, the cover is raised which, with locating surfaces parallel to the direction of displacement on the flanges of the cover and casing body, does not cause any leakage in the flange of the cartridge body.

In principle with the cartridge according to the invention, it is irrelevant whether the flange of the cartridge body is continuous or whether the flange simply consists of webs or the like at a distance from one another. Ultimately, the design of the flange is a question of the design of the device. The flange must be arranged wherever openings are formed between the cartridge recess or bottom of the breech, despise the breech being closed. The dimensions of the flange (even if the flange simply consists of webs, only "flange" is used in the present text) are advantageously determined experimentally (the length and thickness of the flange are not least also dependent on the plastic material used). Even the angle with which the flange of the cartridge body tapers in its tapering section is dependent on the plastics material used. Not least, the gas pressures arising are also of significance.

In an advantageous further development of the invention, as an alternative to the design of the flange of the cartridge body described above, it is provided that the flange extends substantially radially outwards from the end of the cartridge body on the cover side of the latter. With this design of the plastic cartridge, the cartridge is provided with a flat end on the cover side thereof which, in contrast to the embodiment described above, has no indentation. The preferably wedge-shaped tapering flange section of the cartridge body starts immediately at the end on the cover side thereof and extends substantially radially outwards.

To reduce further extrusions of material, an offset may be provided within the space between the cartridge recess and the bottom of the breech. Thus, the flange of the cartridge body preferably has a section angled downwards, and is tapered at least over a part of said angled downwards section. The flange of the cartridge body is therefore bent down, starting from the end of the cartridge body on the cover side thereof. The angled downwards section extends at an acute angle of preferably 10° to 30° to the longitudinal axis of the cartridge body. On account of the offset, the plastic material, which wants to extrude on account of the high gas pressures, is exposed to a "flow resistance". Under certain circumstances, depending on the design, the offset alone can prevent extrusion of material; however, as is also provided with this embodiment of the invention, it is better to produce, in conjunction with the offset, a tapered gap effect which, by means of the tapering flange section, prevents any extrusion of material.

Preferably, the cover and casing body are interlockable, with the interlocking taking place, in particular, between the flanges of the cover and casing body.

An even greater tapered gap effect occurs if, with a flange extending backwards beyond the end of the cartridge body on the cover side, the lateral surfaces of the bottom of the breech, which are matched to the flange alignment, lie against the flange before they lie on the actual cover, and there is therefore a further space between the cover and bottom of the breech. The flange of the cartridge body is therefore already held clamped between the cartridge recess and bottom of the breech, while, above the cover, there is a further small space. Thus, the wedge-shaped flange is prestressed, thus improving the tapered gap effect. During combustion of the propellent charge, this stress is further increased in that the cover (on account of the space existing with respect to the bottom of the breech) is raised slightly and the cover flange is thus pressed against the casing body flange.

Furthermore, there is a certain problem with plastic cartridges in the initiation of the ignition charge by the striker of the firing device. This lies, firstly, in the plasticity of the plastic material, which dampens the energy of the striker, which means that the momentum, with which the striker strikes the cartridge body, must be increased. Secondly, with plastic cartridges, the initiation of the ignition charge causes difficulties, since the ignition charge is introduced between two layers of plastic material. The deformation energy generated by the striker under such conditions, only yields a sufficient increase in temperature in the ignition charge when the pressure (force/area) or deformation under this pressure in the ignition charge is far higher than the plastic allows. Sufficient pressure on the ignition charge can oily be achieved if the ignition charge is accommodated between two metal parts, as is the case with metal cartridges. On account of their material properties, ignition charges cannot be brought to any desired deformadility (force/path). On account of the characteristics described here of thermoplastics, in particular, the use of plastic cartridges in place of metal cartridges in the bolt guns or centrally firing weapons designed for metal cartridges is not possible without further modification.

Consequently, in this respect, a plastic cartridge body is advantageous which has a casing body, open on one side, for accommodating a propellent charge and an ignition charge for igniting the propellent charge when the ignition charge is subjected to pressure, and a cover for closing the open end of the casing body, with a plastic ignition pin coupled to the cover being arranged in a longitudinally displaceable manner in the axial direction in the chamber delimited by the casing body and cover and the ignition pin being movable when a pressure is applied to the cover in the region of its coupling to the ignition pin, and, in order to ignite the ignition charge, acting (mechanically) on it. The ignition pin is thereby coupled to the cover so as to be movable in its axial direction, with the coupling being provided either in the region of the actual cover, by which the casing body is closed, and/or in the region of the flange of the cover. The design of the coupling enables the cartridge body to remain gas-tight even after impacting of the ignition pin by the striker of the firing device. The gas-tightness can also be guaranteed by measures to be taken on the device side, further details of which are given below.

The cartridge body is provided with an ignition pin which is moved forward by the striker acting on the cartridge (cover) and thereby acts with its striking end on the ignition charge in order to initiate it. The energy of the striker is therefore converted into kinetic energy for the ignition pin which, in turn, through deformation of the ignition charge, transfers this energy to the ignition charge in order to ignite it. The ignition pin therefore acts as a transfer element for transferring the striker energy to the ignition charge. Transfer of the striker energy through the wall of the cartridge, i.e. through the cover, which in this respect is rigid, is not provided according to the invention; rather, the cartridge body is provided with an element, namely the ignition pin, for converting the striker energy into kinetic energy. The damping of the striker energy by the plastics material is thereby substantially reduced in relation to known plastics cartridges. Consequently, the plastic cartridge can be triggered with the aid of the striker mechanism designed for metal cartridges without modifications having to be made to the devices.

With the plastic cartridge, slight gas leaks can occur in the region of the striker of the firing device when the cartridge is subjected to extremely unfavourable stresses, this case occurring, for example, if the cartridge body or the cover is damaged by the striker on account of the striking action, and gas escapes, which then disperses further via the space between the striker and striker guide in the bottom of the breech of the firing device. Here, it is advantageous if any gas leak can be prevented via the striker. In this respect, it is advantageous if the striker has a striking end of increased diameter which strikes the cartridge body. The stepped striker is thereby guided in a guide of appropriate design in the bottom of the breech, i.e. with an annular shoulder. If the striker is then pressed back by gas escaping at the point of striking on the cartridge body, its annular shoulder comes into contact with the annular shoulder of the striker guide. In this way, on the one hand, the movement of the bolt is limited, and, on the other hand, sealing of the striker guide is obtained through appropriate design of the shoulders coming into contact. Therefore, like a valve, the striker itself prevents any gas leak via its guide in the bottom of the breech.

In an advantageous further development it is provided that the striking end of the ignition pin acting on the ignition charge be designed so as to extend, preferably conically, to a point, and the ignition charge be arranged in a preferably conical recess or indentation of the casing body, corresponding to the form of the striking end. The casing body is funnel-shaped in the region in which the ignition charge is accommodated in the casing body. Preferably the surface of the recess extends parallel to the outer surface of the striking end of the ignition pin. When the striking end of the ignition pin strikes the ignition charge, the striking pin exerts a pressure on the ignition charge.

However, at the same time, particles of the ignition charge are also rubbed against one another, with the result that the kinetic energy of the ignition pin in the ignition charge is converted into frictional energy. A large frictional path is thereby obtained on account of the pointed, conical ignition pin and the funnel-shaped design of the recess of the casing body accommodating the ignition charge. The frictional energy is therefore generated, in the first instance, by an increase in the depth of penetration of the striking end of the ignition pin into the ignition charge. This is favoured by the design of the striking end of the ignition pin and the recess or indentation in the casing body described here. On account of the "stab ignition principle" according to the invention, adequate ignition of the propellent charge can be achieved with a relatively small amount of ignition charge with a reduced proportion of frictional means, the consequence of which is that contamination of the device, particularly erosion of the device, is substantially reduced in comparison to the previously used cartridges.

With the aid of the above ignition principle, in which the pointed striking end of the ignition pin penetrates into an ignition charge brought, as it were, into the negative or counter-mould relative to the striking end, and the funnel-shaped ignition charge thus formed is arranged in a recess or indentation corresponding to the form of the striking end, reliable ignition can be achieved, despite the arrangement of the ignition material between two comparatively relatively soft plastics parts, since the ignition material is rubbed during relative movement of the two plastic parts and is thereby heated. The frictional energy is obtained by tangential displacement ("shearing") of very small quantities of ignition charge (the thickness of the layer between the wall of the indentation and the striking end is small), which arises from a self-forming pressing system (the pressure to which the ignition charge layer is subjected becomes continually greater on account of the conical surfaces of the striking end and of the indentation). The frictional heat is largely obtained through an enlargement of the friction path at reduced pressure values.

Advantageously, the ignition charge is given a hollow conical form on introduction into the conical indentation of the plastic cartridge. The pointed striking end of the ignition pin first penetrates into the conical cavity of the thus formed ignition charge. Moreover, no energy is required to displace the material of the ignition charge to all sides. Almost all the energy of the ignition pin can be converted into frictional energy when the ignition pin moves forward.

A further advantage of the plastic cartridge according to the invention is that the ignition charge is arranged at a relatively large distance from the opening of the casing body or from the cover of the cartridge. This has particular advantages during loading using mass-production tools; because clean compaction of the ignition charge pellet, which is preferably introduced as a wet charge, is now ensured in this respect, the cartridge (cover and/or casing body) is no longer contaminated or is barely contaminated during mass loading by ignition charge material spilling out during compaction on account of the great depth to which the wet charge is inserted. The compaction of the ignition charge pellet introduced is achieved solely by axial forward movement of the pellet feed plunger. The feed plunger also preferably has a conical tip so that the ignition charge is given the hollow conical form described above during compaction of the ignition charge pellet.

The introduction of the ignition charge in the form of a wet charge has, in the first instance, advantages in terms of safety (lack of dust). The "harder" components of the ignition charge (e.g. glass particles—as a friction agent) can be pressed into its relatively soft plastic material during introduction of the ignition charge into the cartridge, on account of which the ignition charge is "firmly held" by the cartridge. This effect occurs with the cartridge according to the invention both on introduction of the ignition charge in the form of a wet charge and also on introduction in the form of a dry charge.

In an advantageous further development of the invention it is provided that the casing body have a first receiving chamber, corresponding in cross-section to the ignition pin, for accommodating the ignition charge and the ignition pin, and that the ignition pin be guided in a longitudinally displaceable manner in the first receiving chamber. In this respect, the first receiving chamber preferably has the form of a blind hole. The conical recess for (at least partially) accommodating the ignition charge is advantageously arranged at the end opposite the opening of the first receiving chamber. The outer peripheral surface of the ignition pin can lie sealingly against the inner surface of the first receiving chamber. Both the first receiving chamber and the ignition pin are preferably cylindrical. The design of the first receiving chamber described here enables the ignition charge to be introduced particularly easily into the cartridge, without the cartridge being contaminated by ignition charge substance. The guiding of the ignition pin on all sides into the first receiving chamber guarantees reliable guiding of the ignition pin without it being able to jam.

In an advantageous further development of the invention it is also provided that the ignition pin be of increased cross-section in its region facing the cover for longitudinally displaceable guiding in the first receiving chamber, such cross-section being slightly smaller than or equal to the cross-section of the first receiving chamber. The rear part of the ignition pin is therefore of increased cross-section and, in this region, lies against the inner surface of the first receiving chamber. The ignition pin is narrower in the region of its striking end, on account of which the pointed striking end is surrounded on all sides by ignition charge material on penetration into the ignition charge.

Preferably, the ignition pin is provided with a continuous radial sealing lip moulded on in a single piece and for lying against the inner wall of the first receiving chamber. The sealing lip is, moreover, preferably designed in such a manner that it is pressed by the increased combustion gas pressure against the inner surface of the first receiving chamber when the ignition charge is ignited. Leaking of the combustion gases from the first receiving chamber in an unintended direction is thereby prevented and return movement of the ignition pin is stopped by the contact pressure of the sealing lip against the inner surface of the receiving chamber.

In an advantageous further development of the invention it is provided that the cover have increased flexibility in the region of the coupling to the ignition pin. This increased flexibility enables the forward movement of the ignition pin when the firing pin is acting on the cartridge. Preferably, the ignition pin is connected to the cover in a single piece, with the connection being created in such a manner that the ignition pin is displaceable in the axial direction whilst maintaining the connection with the cover. Such a connection can, for example, be achieved by means of corresponding elasticity of the cover in the region of the connection to the ignition pin. To this end, it is advantageously provided that, in its edge region around the end of the ignition pin connected thereto, the cover is thinner than in the remaining region thereof. The material characteristics of the plastic of the cartridge are such that the elasticity allows movement of the ignition pin whilst maintaining the mechanical connection with the cartridge.

Advantageously, the ignition pin is hinged to the cover at its end facing away from the striking end and is connected to the cover. This hinged connection can be achieved, for example, by an integral hinge or an annular membrane. All the aforementioned connections have the advantage that the ignition pin can be manufactured in a single piece with the cover as an injection moulded plastic part.

It is advantageous if the hinged connection between ignition pin and cover is designed in such a manner that the plastic material undergoes no elongation whatsoever when the ignition pin is moved forward. This is achieved by the cover extending in the annuler region around the ignition pin so as to rise towards the ignition pin in the manner of a truncated cone. In this respect, the ignition pin is located in its rearward or inoperative position which it assumes in order to be moved forward during the action of the firing pin. Once the firing pin has acted on the ignition pin, the ignition pin is moved forward further into the casing body, with the annular region then extending downwardly towards the end of the ignition pin; this is because, when the ignition pin is in its forward position, the outer surface of the cover projects over the end face of the ignition pin, and the ignition pin is therefore pushed in. The hinged connection between the ignition pin and cover has the advantage that the firing pin energy is not required for extending the plastic material, and the firing pin therefore strikes the ignition charge with greater energy.

In an advantageous further development of the invention it is provided that, in addition to its elongated first part chamber, corresponding in cross-section to the ignition pin, the first receiving chamber have a second part chamber which opens into said first part chamber in the conical region of the first partial chamber. The ignition charge pressed into the first receiving chamber, and preferably introduced as a wet charge, is introduced during loading by the feed plunger both into the second part chamber and into the conical region of the first part chamber of the first receiving chamber. The material of the ignition charge extends, as a result, in the form of a continuous layer connecting the two part chambers to one another. The substantially smaller proportion of ignition charge material is located in the conical indentation of the first part chamber. On ignition of the ignition charge material in the first part chamber, the ignition charge material located in the second part chamber also ignites as a consequence. Therefore, only a limited proportion or region of the ignition charge is heated by friction beyond the self-ignition temperature. On account of the low mass or low volume of ignition charge material in the first part chamber, the heat dissipation is also lower when the ignition pin is acting, and the ignition charge is therefore more likely to ignite.

With the cartridge according to the invention, Lt is also advantageous that the ignition charge and propellent charge be accommodated, completely separated from one another, in the casing body. To this end, both charges are accommodated in separate receiving chambers, with the separating wall separating the two chambers from one another being designed as a rapture wall which breaks open when the ignition charge is ignited, with the result that the combustion gases reach the propellent charge and ignite it. The rupture wall either has a wall thickness guaranteeing breaking open after a certain (combustion) gas pressure in the first receiving chamber or has corresponding predetermined breaking points.

Advantageously, the casing body is provided with predetermined breaking points (star impression) in the region of the (second) receiving chamber for the propellent charge, in order to facilitate or allow the breaking open of the cartridge when the propellent charge is ignited.

As has already been mentioned above, the cartridge according to the invention can be used both for firing devices with rim ignition and for firing devices with central ignition. Depending on the type of device, the ignition pin is located at various positions or the cover, namely in the first case in the rim region, i.e. off-center, and in the second case in the central region of the cover. The exact arrangement of the ignition pin depends on the position of the firing pin of the firing device. The off-center arrangement of the ignition charge in the rim region is advantageous for the aforementioned stability or strength of the cartridge in a firing device using magazined cartridges, with all ignition pins being arranged along the center line of the magazine belt. The ignition pin of a cartridge is therefore arranged in the region facing an adjacent cartridge. In this region, the cartridge recess does not completely surround the casing body. When the cartridge is ignited, the ignition pin acts in a manner increasing the strength, since it is arranged between the propellent charge and the region of the cartridge recess which is "open at the side".

The arrangement of the ignition pin in the edge region of the cartridge also has the advantage that the ignition charge is protected against the environment only by the wall of the casing body. This protection is sufficient with respect to external mechanical effects and, in the case of the effects of heat on the cartridge, also enables the ignition charge to turn off harmlessly on account of the thin-walled nature of the casing body in this region, with the rupture wall between the ignition charge and the propellant charge preventing ignition being transferred to the propellent charge. On account of the poor thermal conductivity of plastics, the ignition charge withstands short term thermal effects (temperatures over 130° C. are noncritical in any case). The ignition charge is particularly well protected with the preferred arrangement of the ignition charge on the central longitudinal axis of the magazine strip.

The above advantageous embodiments of the cartridge are also provided when the individual cartridges are in a belt magazine. The cartridge belt magazine is substantially formed in two parts and consists of several casing bodies integrated in a plastics strip and several breech cover parts for closing the open sides of the casing body integrated into a breech cover strip. In order to be able to compensate for differences between the spacing of the casing bodies on the one hand and the spacing of the breech cover parts on the other hand, according to an advantageous further development of the cartridge belt magazine, it is provided that the individual breech cover parts are elastically connected to one another (by means of flexible integral hinges). In the region of its integral hinges, the plastic breech cover strip extends in an arc-shaped manner, i.e. at a distance from the casing body strip. In this way, the distance between adjacent breech cover parts can be matched to the distance between associated adjacent casing bodies.

In the region of its integral hinges, the breech cover can be just as wide as the breech cover parts; however, it is also possible for the lateral edges of the integral hinges to be designed with edge recesses. Thus, (edge) discharge holes or openings, directed inwards towards the upper side of the breech cover strip, are produced. In the event of a leak of gas from a cartridge between a breech cover part and a casing body, raising of the breech cover part or even a transfer of ignition to adjacent cartridges is prevented in that the gas can dissipate via the discharge holes or openings in the region of the integral hinge before it reaches the adjacent cartridges. However, the integral hinges can also be designed in the manner of flexible tongues or webs with interposed free spaces; the free spaces then represent the discharge holes or openings.

The breech cover strip is advantageously held in a clamping and locking manner on the casing body strip. To this end, the casing body strip advantageously has, on its two long sides, thickened edge strips projecting over the surface of the upper side provided with the casing body openings, these edge strips being substantially square or rectangular in cross-section. The breech cover strip is inserted with its outer lateral edges clamping and locking against the inner surfaces, facing one another, of the edge strips which are designed in the manner of flanges.

Both edge strips are directed laterally outwards, away from one another, at one end of the plastics casing body strip. Free spaces are formed at this end between the edge strips and the remaining part of the casing body strip. The ends of the edge strip directed away from one another form a barrier which prevents the introduction of the cartridge belt magazine if it is incorrectly aligned.

In the above example of a cartridge belt magazine, the arrangements for positioning the belt magazine (edge recesses or the like) to be provided on the long edges of the belt magazine can be provided either on the casing body strip or on the cover strip. The cartridge magazine can be designed both as an annular magazine and as a linear belt magazine.

BRIEF DESCRIPTION OF THE DRAWINGS

An embodiment of a belt magazine with individual cartridge bodies is described in greater detail hereinafter with reference to the accompanying drawings wherein:

FIG. 3 is a cross-section through the cartridge belt magazine taken along the line III—III in FIG. 1, with the cover and the casing body strips of the belt magazine being shown in the non-locked together state;

FIG. 4 shows a cartridge of the cartridge belt magazine in the cross-section taken along the line IV—IV in FIG. 2, with the cartridge introduced into the breech of a firing device, but with the striker not yet acting on the cartridge;

FIG. 5 is a partial cross-sectional view of the cartridge according to FIG. 4, with the striker acting thereupon and with the ignition and propellent charges ignited;

FIGS. 10 and 11 show longitudinal sections through a further embodiment of a cartridge inserted in the breech of a firing device in order clearly to show the impermeability of the cartridge despite displacements of its cover and in order to show taper pre-stressing.

DETAILED DESCRIPTION OF THE INVENTION

Figure 1:
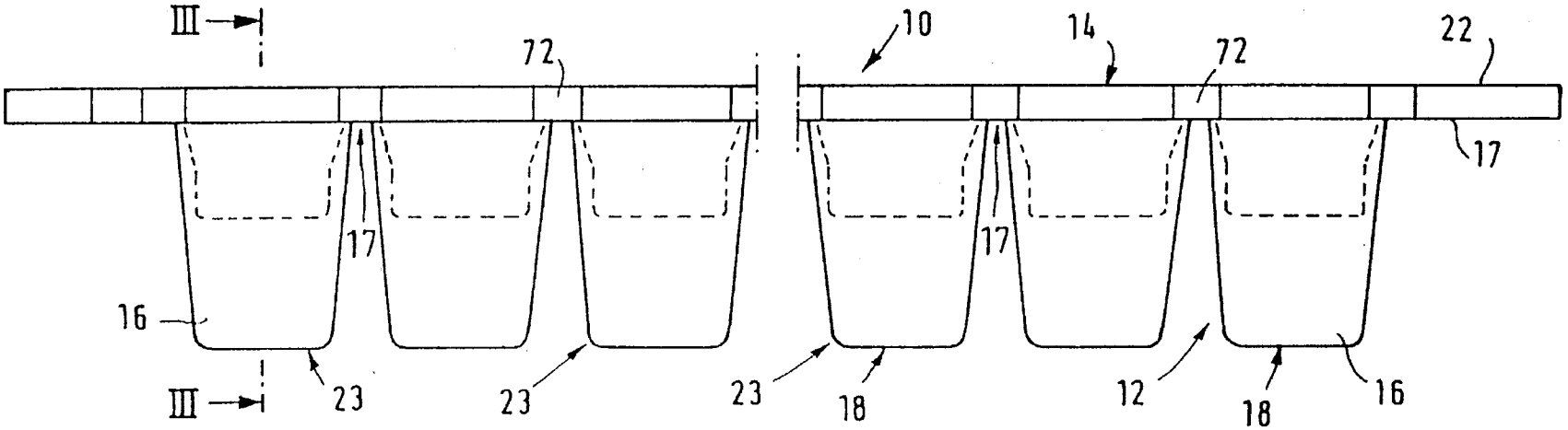
FIG. 1 is a side view of a linear cartridge belt magazine with 10 cartridges in the assembled state.
Figure 2:
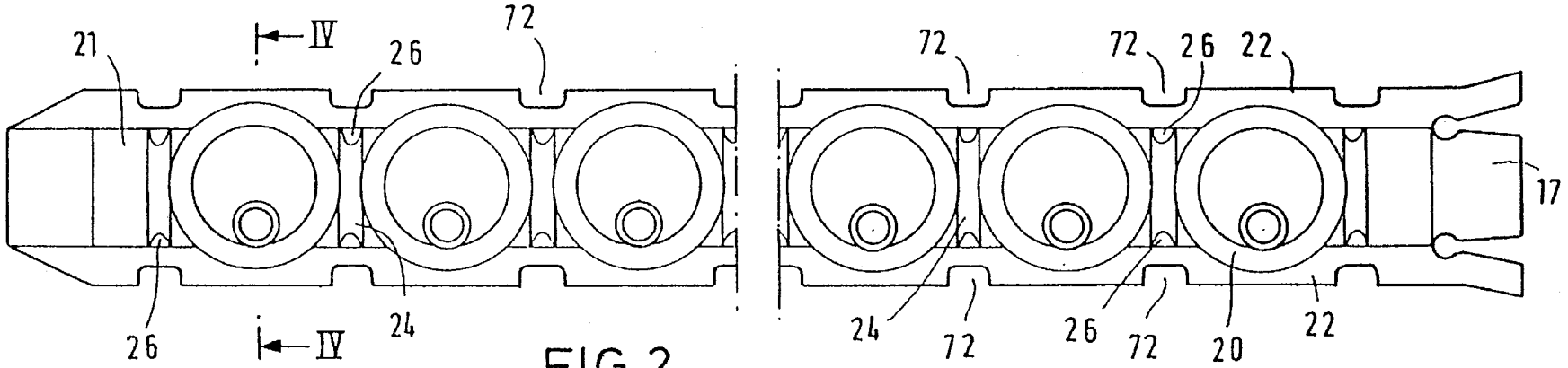
FIG. 2 is a plan view of the upper side of the cartridge belt magazine in which the upper side of the breech cover strip can be seen.

FIGS. 1 and 2 show a plastic cartridge belt magazine in a side view and a plan view, respectively. The belt magazine consists of two plastic strips connected in an interlocking manner, namely a casing body strip 12 and a breech cover strip 14. The casing body strip 12 has several casing bodies 16 arranged lying one next to another, which are connected to one another via a plastic edge 17 of the casing body strip 12 and which each have a cap-like truncated conical form with a flat bottom part 18 facing away from the breech cover strip 14. The casing bodies 16, which are open towards the breach cover strips 14, are closed by breech cover parts 20, which are hinged to one another and are integrated into a plastics belt 21 of breech cover strip 14. The casing body strip 12 has bead-like edge strips 22 on both of its longitudinal sides. These edge strips 22 project upwards over the breech cover strip 14 and enclose it between them in a gripping and locking manner. Both the casing body strip 12 and the breech cover strip 14 are produced in a single piece as plastic injection moulded parts. The casing bodies 16, together with the breech cover parts 20, form the cartridge bodies 23. The substantially rectangular breech cover parts 20 are connected to one another via membranes acting as integral hinges. In the region of the integral hinges 24, the breech cover strip 14 is of reduced thickness. The integral hinges 24 are provided at both their free edges, with edge recesses 26. The significance of these edge recesses 26 is described hereinafter.

The more precise structure of a cartridge body 23 is described below with reference to FIG. 3. The breech cover part 20 comprise has a closed collar-type rim 28 projecting downwards at right angles to a planar closure portion. In plan view, the rim extends like a sickle. In the region defined by the rim 28, the breech cover part 20 is of greater thickness than in the remaining region. The rim 28 extends tapering conically towards its free end; the cylindrical outer surface 28*a* of the rim 28 extends perpendicularly to the upper side of the closure portion of the breech cover part 20 and thus parallel to the longitudinal axis 29 of the cartridge body 23.

Connected in a single piece with the breech cover part 20 is a plastic ignition pin 30 which, just like the rim 28, projects downwards from the closure portion of the breech cover part 20. The cylindrical ignition pin 30 is of greater diameter in the section which adjoins the end connected to the breech cover part 20 than in the region of its free (striking) end 32. This free end 32 of the ignition pin 30 is conical and extends to a point. The ignition pin 30 is provided in the region of transition between the section of greater diameter and the section of smaller diameter of the ignition pin 30, with an axially open annular groove 34, so that a sealing lip 36 of greater diameter is provided, moulded onto the section.

The ignition pin 30 is located next to the rim 28 of the breech cover part 20, which extends in a sickle-like manner, with the section of the rim 28 facing the ignition pin partially enclosing the ignition pin 30 and extending parallel to the circumference of the ignition pin 30. The breech cover strip 14 is of reduced thickness in the annular region 38 around the end 40 of the ignition pin 30 connected to the breech cover part 20; the annular region 38 is formed like a membrane or an integral hinge which allows axial movement of the ignition pin 30 while maintaining the connection with the breech cover strip 14 or the breech cover part 20. The annular region 38 extends, rising up towards the end 40 of the ignition pin 30, with the end face at the end 40 of the ignition pin 30 being in alignment with the breech cover outer surface 42 when the ignition pin 30 is in the return or starting position represented in FIG. 3. In this starting position, as will be described hereinafter, the firing pin of, for example, a bolt gun acts on the end 40 of the ignition pin 30 in order to move the ignition pin 30 forward axially into its forward position in which the striking end 32 acts mechanically on an ignition charge accommodated in the casing body 16. When the ignition pin 30 is in its forward position, the end face of the end 40 of the ignition pin is located under the outer surface 42 of the breech cover part, with the annular region 38 extending down towards the end 40 of the ignition pin 30. As can be seen from FIG. 3, the breech cover part 20 has a circular recess 44, in the region of which the ignition pin 30 is connected to the breech cover part 20 via the annular region 38 of the integral hinge.

The construction of the casing bodies of the casing body strip 12 is described with reference to FIG. 3. The casing body 16 has a first receiving chamber 46 and a second receiving chamber 48. The two receiving chambers 46, 48 are separated from one another by a separating wall 50 and are otherwise delimited by the wall of the casing body 16. The first receiving chamber 46 is used to accommodate the striker pin 30 and the ignition charge 52. Consequently, the first receiving chamber 46 exhibits a substantially cylindrical partial space, like a blind hole, with a base of the hole being designed as an indentation 53. In the region of its opening the first receiving chamber 46 is of increased diameter. This arrangement facilitates the introduction of the ignition pin 30 when the breech cover strip 14 is placed on the casing body strip 12. The second receiving chamber 48 has an opening 55. In addition to the previously described, substantially cylindrical first partial chamber 56, the first receiving chamber 46 also encloses a second partial chamber 58 which opens, in the region of the conical end 53 of the first partial chamber 56, into the first partial chamber 56. The two partial chambers are connected to one another via the conical wall of the first partial chamber. The second partial chamber 58 is used to accommodate the ignition charge 52, which is also partly accommodated in the first partial chamber 56, and indeed in the region of its conical end 53. The second partial chamber 58 is separated from the second receiving chamber 48 by the separating wall 50.

The second receiving chamber 48 is used to accommodate the propellent charge 60, which is ignited by the combustion gases being produced when the ignition charge 52 is ignited. The second receiving chamber 48 extends into the region of the bottom 18 of the casing body 16, where the casing body 16 has, on its inside, a star impression for producing predetermined breaking points, indicated by reference numeral 62 in FIG. 3.

However, a further special feature of the cartridge body 23 can also be seen with reference to FIG. 3. The breech cover part 20 has an annular flange 80 which projects from the upper side 42 of the breech cover part 20. The breech cover part 20 is inserted into the casing body 16 until its flange 80 lies inside and against the casing body 16. The casing body 16 also has a flange 82, which is essentially an extension of the wall of the casing body 16. The dimensions, particularly the thickness dimensions, of both flanges 80, 82 are selected such that a wedge-shaped section 84 is formed in the region in which the two flanges touch, the wedge-shaped section 84 tapering as the distance from the upper side 42 of the breech cover part 20 increases. This can be seen particularly with reference to FIGS. 4 and 5, which have yet to be described. At their free ends 86, 88, the two flanges 80, 82 have intermeshing teeth which act as a locking connection between each breech cover part 20 and the associated casing body 16. Seen in the plan view of FIG. 2 and in FIG. 3, an indentation 90 is therefore formed for each cartridge body 23. The alignment of the two flanges 80, 82 of the breech cover part 20 and the casing body 16 relative to the longitudinal axis 29 of the cartridge body 23 is selected such that the flange 84 of the cartridge body 23 composed of two flanges 80, 82 (see FIGS. 4 and 5) extends at an angle of 10° to the longitudinal axis 29. Thus, the flange 84 corresponds with respect to its alignment to the clonicity of the cartridge body 23. The cartridge bodies 23 are connected to the transport strips of the belt magazine 10 via the flange 84. The flange 84 of a cartridge body 23 is the section which, when the cartridge body is located in the breech, leads outwards to outside the breech via the space between the cartridge recess and bottom of the breech.

The mode of operation of assembled cartridge 23 will be described in greater detail with reference to the cross-sectional views shown in FIGS. 4 and 5.

The cartridge 23 is located moreover in the (partly represented) closed bolt gun, which consists of the cartridge recess 94 and the bottom of the breech 96.

When the belt magazine 10 is in the assembled state, with the breech cover strip 14 being placed on the casing body strip 12, the rim 28 of the breech cover part 20 is sunk into the second receiving chamber 48, with its outer surface **28*a* lying closely against the inner surface 50*a* of the casing body 16, delimiting the second receiving chamber 48 in the region of its opening 55, and against the separating wall 50. The surfaces 28*a* and 50*a* extend parallel to one another and are designed as locating surfaces. When the cover part 20 is inserted in the casing body 16, the ignition pin 30 is sunk into the first partial chamber 56 of the first receiving chamber 46, with its striking end 32 being arranged at a distance from the indentation 53 at the end of the first partial chamber 56. The ignition pin 30 is initially located in its inoperative position, in which the end face of its end 40 connected to the breech cover part 20 projects over the surface 42 of the breech cover part 20. While the propellent charge 60 completely fills the region of the second receiving chamber 48 underneath the edge 28 of the breech cover part, the ignition charge 52 has a cavity 64 on its side facing the striking end 31. This cavity is produced during loading by the manner of introducing the ignition charge. The ignition charge 52 is first introduced in the form of a wet charge pellet into the first partial chamber 56 of the first receiving chamber 46. Then, the wet charge pellet is pushed far into the receiving chamber 46 with the aid of a feed plunger with a conical end, with the material of the ignition charge 52 being pushed both into the second partial chamber of the first receiving chamber 46 and into the conical indentation of the first partial chamber 56. On account of the conical design of the end of the feed plunger, the material of the ignition charge 52 located in the first partial chamber 56 is brought into the form represented in FIGS. 6 and 8, which is largely like a hollow cone. The end 53 of the first partial chamber 56 of the first receiving chamber 46 is thus covered with 3 relatively thin coating thickness of ignition charge material. When the ignition charge 52**, introduced as a wet charge, dries, it retains its form.

To activate the cartridge, the striker indicated by reference numeral 66 in FIGS. 4 and 5 acts on the end 40 of the ignition pin 30 connected to the breech cover part 20, whereupon the ignition pin 30 is pushed axially forward in the longitudinal direction inside the first receiving chamber. The striker 66 is guided in an axially displaceable manner in a guide hole 98 in the bottom of the breech 96. It has an annular shoulder 100 facing away from the cartridge recess 94, the annular shoulder 100 lying in a gas-tight manner against a counter annular shoulder 102 facing the cartridge recess 94 when the firing pin 66 is located in its return position in which its striking end 32 lies against the end 40 of the ignition pin 30 connected to the breech cover part 20. In order to move the striker 66 forward, a force acts, in a pulsed manner, on its end (not shown) facing away from the cartridge body 23; the device's striker is therefore divided in two, as it were. During the forward movement of the ignition pin 30, on account of the action of the striker 66, the conical striking tip 32 of the ignition pin 30 acts on the layer of ignition charge at the conical end 53 of the first receiving chamber 46. In this connection, frictional heat is generated in the layer of ignition charge, which finally leads to ignition of the ignition charge material. The frictional heat is obtained, to a very large extent, on account of the relatively long friction path of the striking end 32 in the layer of ignition charge; the pressure with which the striking end 32 of the ignition pin 30 acts on the ignition material rather plays the subordinate role. The choice of material for the casing body 16 (plastics) favours the ignition of the ignition charge 52, since the frictional heat generated therein on account of the relatively poor thermal conductivity of plastic is barely dissipated. Once the ignition charge 52 has ignited, combustion gases develop. The rapidly rising gas pressure in the first receiving chamber presses the sealing lip 36 of the ignition pin 30 against the inner wall of the first receiving chamber and thus provides a gas-tight seal of the first receiving chamber 46 with respect to the outside and a high contact pressure, through which the ignition pin 30 is secured against displacement in the direction of its inoperative or return position. The rise in gas pressure finally causes the bursting open of the separating wall 50 which, in this respect, (also) performs the function of a rupture wall. The hot combustion gases flowing out of the first receiving chamber 46 into the second receiving chamber 48 ignite the propellent charge 60, whereupon the casing body 16 bursts open in the bottom region 18 and release the flow of gas. The situation described here is shown in diagrammatic view in FIG. 5.

If the breech cover part 20 were permeable or weakened in the annular region on account of the mechanical effects of the striker 66, gas can dissipate upwards from the cartridge body 23 via the first receiving chamber 46, past the ignition pin 30. This results in a return movement of the striker 66. The shoulder 100 of the striker 66 thereby strikes against the shoulder 102 of the guide hole 98 in the bottom of the breech 96. The contact between these two shoulders is gas-tight, which means that the striker 66 seals the bottom of the breach 96 like a valve.

The tapered gap principle which is used in the conically tapering flange section 84 of the cartridge body 23 is described briefly, hereinafter with reference to the illustration in FIG. 5. In this flange section 84, the gas pressure arising inside the cartridge body 23 acts in the direction of the extension of the flange. On account of the plasticity of the plastic material of the casing body and breech cover, pressure on the material occurs in the region of the end of the cartridge body 23 on the cover side. This compression on the material normally results in extrusion of material via the space between the cartridge recess 94 and the bottom of the breech 96, which is filled by the flange 84. However, since, like the flange 84 which is composed of the two flanges 80 and 82, this space tapers in the direction of spreading of the gas pressure wave, a tapered gap effect occurs, via which the pressure on the material at the end of the flange 84 facing away from the breech cover part 20 is reduced, on which the plasticity of the plastic material withstands the pressure.

As can be seen on reference to FIGS. 4 and 5, the striking end 32 of the ignition pin 30 is located in its rearward or inoperative position (FIG. 4) at a distance from the indentation 53 of the first receiving chamber 46, while, when the ignition pin 30 is in its forward position (FIG. 5), the conical surface of the striking end 32, lies against the surface of the indentation of the first receiving chamber 46. So that the ignition pin 30 can be moved forward in the axial direction to strike against the indentation 53 of the first receiving chamber 46, the plane in which the opening of the first receiving chamber 46 lies is separated from the ignition pin 30 by the annular region 38 Connecting to the cover part 20. When the ignition pin 30 is in its forward position, the annular region 38 extends around the end 40 of the ignition pin 30, partly in this space above the opening of the first receiving chamber 46 (see FIG. 5).

As can be seen in FIG. 2, the edges 22 of the casing body strip 12 have outer edge recesses 72, which are arranged at the height of the integral hinges connecting the individual breech cover parts 20. The recesses 72 do not extend across the entire width of the edges 22. The recesses 72 determine the distance by which the belt magazine 10 must be pushed forward in order to load the next cartridge 23.

The two edges 22 are separated at one end of the casing body strip 12 from the remaining part thereof and extend outwards, directed away from one another. The width of the casing body strip 12 at this end is therefore greater than in the remaining region of the casing body strip. In this way, incorrect introduction of the belt magazine 10 into the firing device is prevented.

The belt magazine 10 represented in the figures or the cartridges 23 incorporated into it, have the features and characteristics listed hereinafter. The entire belt magazine 10 consists only of two injection moulded plastic parts, namely the casing body strip 12 and the breech cover strip 14. Correspondingly, each cartridge 23 only consists of the plastic casing body 16 and the plastic breech cover part 20. The frictional energy required to ignite the ignition charge 52 is generated by the conical striking end 32 of the ignition pin 30 and the conical indentation 53, in which a part of the ignition charge 52 is accommodated, during the action of the striking end 32 on the ignition charge, as a result of a relatively long friction path. On account of this stabbing ignition principle, the ignition charge 52, despite its arrangement between two relatively soft plastics parts, namely the striking end 32 of the ignition pin and the wall of the indentation 53 in the first receiving chamber 46, can be reliably ignited with correspondingly low ignition forces. The ignition pin 30 is connected in a single piece with the breech cover parts.

The ignition charge 52 is introduced relatively deeply into the casing body 16 so that contamination in the region of the casing body opening 55, and therefore leaks in the breech cover parts, cannot occur. The ignition charge 52 can be accommodated in the first receiving chamber 46 simply by introducing a charge pellet axially into the first receiving chamber 46. This axial introduction is quite simple from a production viewpoint and is thus cheap to implement. The tool used for this purpose is, for example, an axially displaceable plunger which presses the charge pellet axially into the first receiving chamber 46 as far as its conical indentation 64. Several such plungers can operate simultaneously in order simultaneously to load a plurality of cartridges with ignition charges. This is simpler, faster and cheaper than the previously usual introduction of ignition charges by "smearing" the ignition charge in the furrows of casings or cartridges using a rotary screwdriver-like tool. In the event of fire or heating outside the firing device, the lateral arrangement of the ignition charge allows harmless detonation of the ignition charge without ignition being transferred to the propellent charge.

As indicated by reference numeral 74 in the figures, the wall of the casing body 16 is relatively thin in the region of the conical indentation of the first receiving chamber 46 and is produced by a recess 76 formed in the conical indentation 53. On account of the special arrangement of the ignition charge material in the form of a funnel and the aforementioned ignition principle, reliable ignition of the propellent charge can be achieved with less ignition charge material. Thus, there are also fewer residues in the firing device and lower pollutant emissions. Finally, more space remains in the cartridge for the propellent charge.

The rim 28 of the breech cover part 20 acting as a sealing lip is pressed by the gas pressure securely against the inner wall of the casing body when the propellent charge is ignited, so that no gas can escape via the breech cover part 20 and the ignition pin 30 is held firmly clamped. The gas-tightness in the space in which the flange 84 of the cartridge body 23 is arranged, which is not closed by the cartridge recess 94 or by the bottom 96 of the breech in the direction of spreading of the pressure, will prevent extrusion of material by the tapered gap effect. Thus it is possible to use polypropylene as the plastic material for the casing body and breech cover part of the cartridge body 23. The gas-tightness at the limiting surface between the flange 80 of the breech cover part 20 and the flange 82 of the casing body 16 is also obtained as a result of the tapered gap effect in the conically tapering flange section 84 of the cartridge body 23, namely by achieving gas-tight contact between the flanges 80 and 82 on account of the severe pressure acting on the cartridge recess 94 and bottom of the breech 96. The ignition pin 30 is also held firmly clamped when the propellent charge 60 is ignited and indeed by the contact forces of the edge 28 of the breech cover part which act on the ignition pin 30 via the separating wall 50.

If combustion gases nevertheless escape via the breech cover part 20, then its transfer to an adjacent cartridge is prevented on account of the edge recesses 26 of the integral hinges 24 of the breech cover strip 14. In the case described above, the edge recesses 26 act as discharge holes or openings, via which the gases can escape before they reach the adjacent cartridge 23.

The casing body strips and breech cover strips produced in the form of belts can be injection moulded in a lattice so that multiple handling during manufacture is possible with the simplest means. Several casing body strips and several breech cover strips are therefore manufactured separately from one another. Then, the casing bodies arranged in the lattice are furnished with the ignition and propellent charges. Then, the breech cover part lattice is put in place. The introduction of the ignition pins into the openings of the casing bodies is thereby facilitated by the first receiving chambers which are enlarged in the opening region. Since, when the ignition pins 30 are located in the rearward position, the rims 28 of the breech cover parts 20 project downwards over their sealing lips 36, the rims 28 are already sunk into the casing body before the ignition pin can be pressed around if the breech cover parts are carelessly put in place. Also, an ignition pin 30 not extending coaxially to the first receiving chamber 46 can consequently be introduced reliably and without problems into the first receiving chamber 46 during the manufacture of the belt magazines.

When the cartridge 23 is operated, the quantity of ignition charge, arranged in a funnel-shaped manner in the first receiving chamber 46 and the indentation 53, force the ignition pin 30 into the "ignition center", even if the ignition pin 30 is deformed, and thus guarantee correct operation.

Other embodiments of the tapered gap in the flange of the cartridge body are described hereinafter with reference to FIGS. 6 to 11, wherein the tapered gap formed in each case is indicated by dot-and-dash lines. Where possible, parts equivalent to the parts in FIGS. 1 to 5 have been given the same reference numerals.

Figure 6:
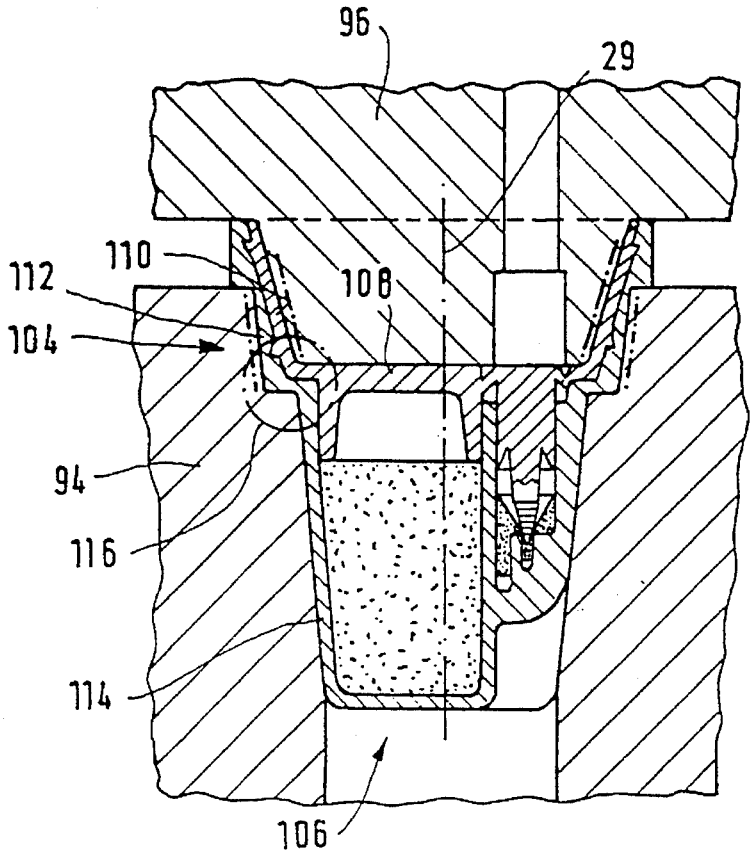
FIGS. 6 to 9 show cross-sectional views of various embodiments of the cartridge, wherein said cartridges are each inserted in the breech of the firing device.

As with the embodiment of a cartridge body 23 represented in FIGS. 1 to 5, the flange 104 of the cartridge body 106 shown in FIG. 6 also projects backwards over the end of the cartridge body 103 on the cover side. As a result, the flange 104 extends at an angle of approximately 10° to the longitudinal axis 29 of the cartridge body 106. As in the example in FIGS. 1 to 5, the bottom 96 of the breech has a projection penetrating into the chamber enclosed by the annular flange 104, the lateral surfaces of this projection lying against the inner surfaces of the flange 104 and the front surfaces of said projection lying on the breech cover part 108. The flange 104, which is composed of a flange 110 of the breech cover part 108 and a flange 112 of the casing body 114, does not simply represent an extension of the side wall of the casing body 114, but is also arranged offset radially outwards with respect to the casing body 114. In the transition region between the flange 104 and the casing body 114, the material is offset so that a stepped region 116 is produced. Adjoining this offset 116 is the flange 104, which tapers as the distance from the casing body and breech cover part increases. The offset represents a resistance for the plastic material of the cartridge body 106 which is stressed by the gas pressure; this measure alone reduces the tendency towards extrusion of material, which is fully eliminated by the tapered gap effect in the conically tapering flange 104, which fills the conically tapering space between the cartridge recess 94 and the bottom 96 of the breech.

Figure 7:
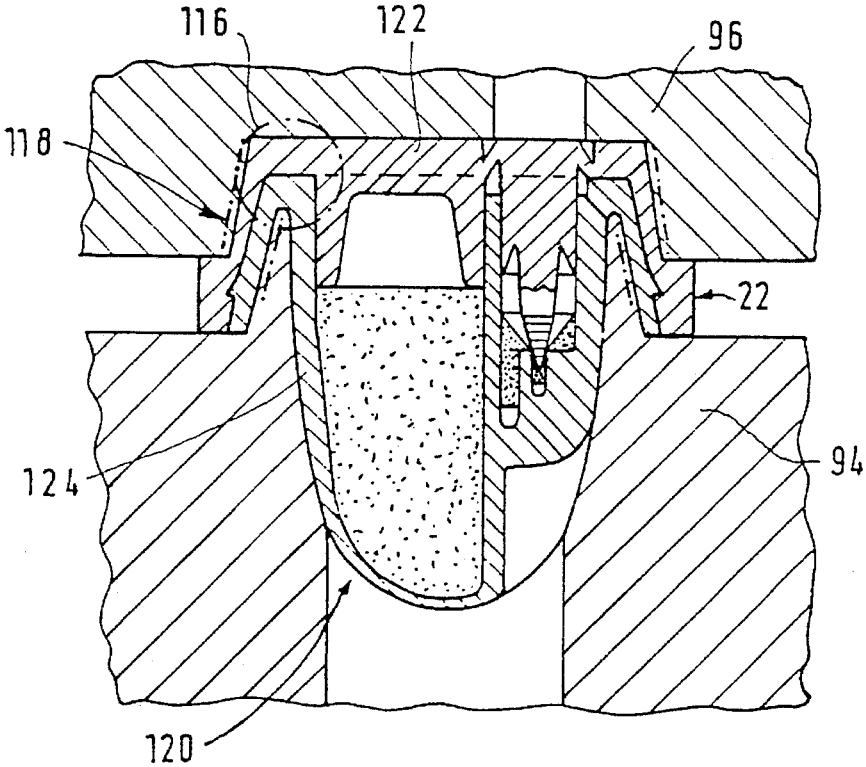

A further embodiment of an offset region in front of the tapering flange is shown in FIG. 7. The offset region 116 in this embodiment extends over almost 180°, in the instant case over around 160° to 170°. Thus, a bent down flange 118 of the cartridge body 120 is formed in FIG. 7. The flange 118 is conically tapered in its section pointing downwards, in its section adjoining the offset 116. The way in which the cartridge body 120 acts to prevent extrusion of material is like in the embodiment represented in FIG. 6. The breech cover part 122 of the cartridge body 120 extends above the free end of the flange 118. Consequently, the bottom of the breech 96 has a recess into which the breech cover part 122 is positioned when the breech is closed. The cartridge recess 94 has a collar, facing the bottom of the breech 96, which projects into the space between the casing body 124 and the flange 118. In the embodiment in FIG. 7, the long edges 22 of the belt magazine 10 having the transport recesses 72 are formed by the ends of the flange moulded onto the breech cover part 122. In contrast to this, in the embodiment shown in FIG. 9, the long edges 22 with their transport recesses 72 are formed by the flange 126 adjoining the casing body 124. The free end 128 of this flange 126 is placed around the free end 130 of the flange 132, which is connected to the breech cover part 133. The breech cover part 133 of the cartridge body 134 according to FIG. 9 extends above the end 126 of the flange 128. The flange 118 is also connected to the actual cartridge body 134 via an offset region 137. The flange 136 is designed in the section thereof adjoining the offset region 137, to extend conically towards the ends 130, 128 in order to achieve the tapered gap effect.

Figure 8:
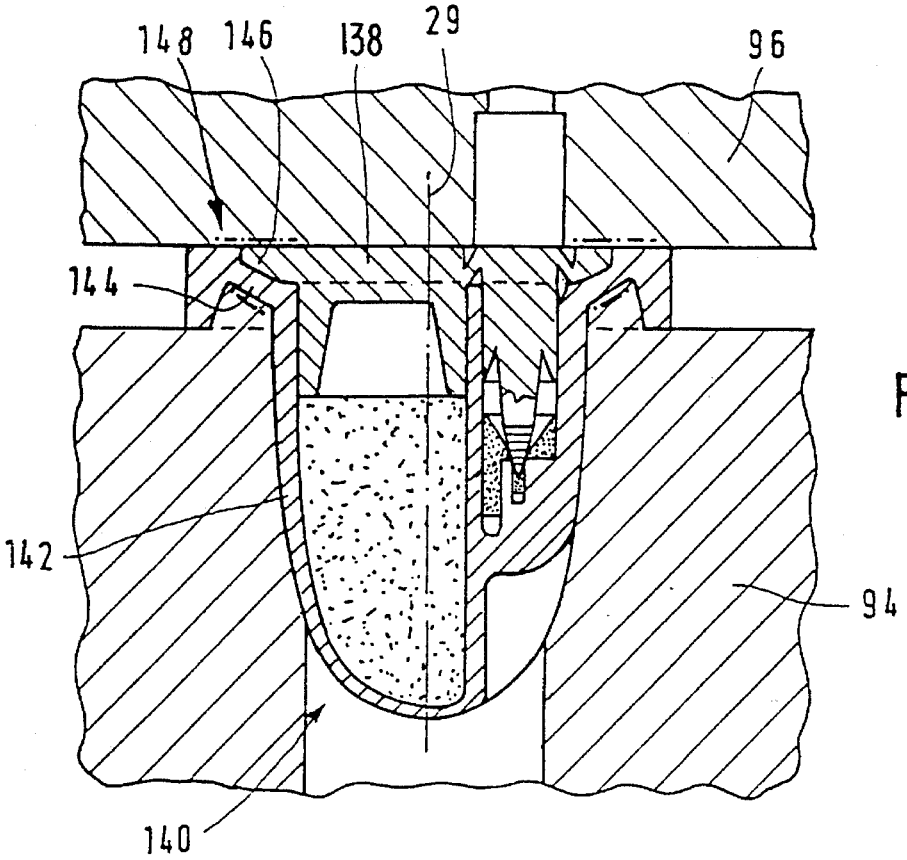
Figure 9:
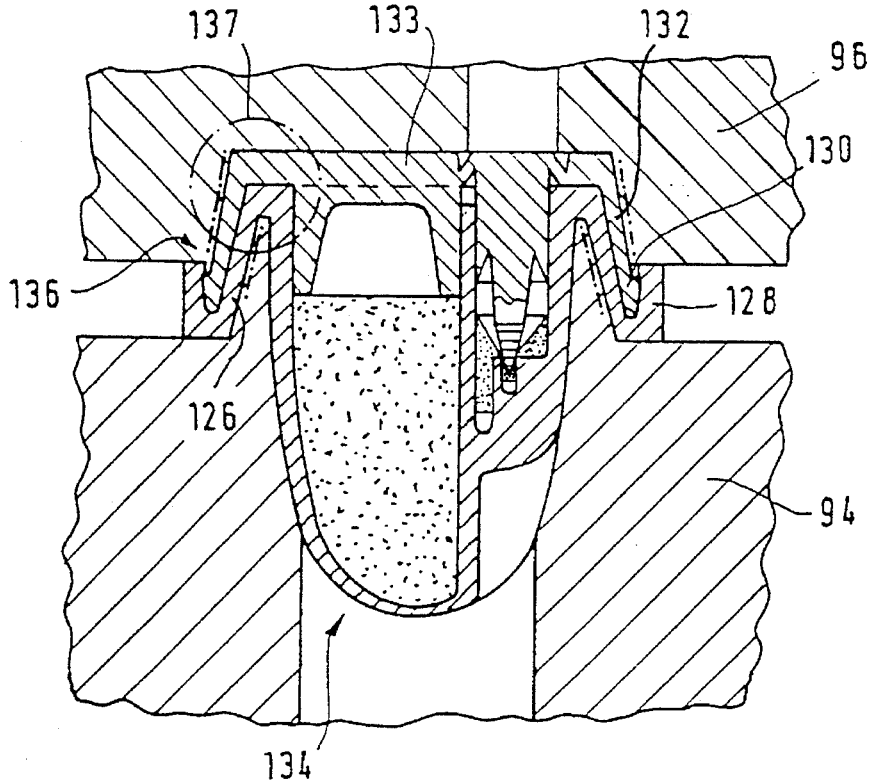

A further embodiment of a conical flange is shown in FIG. 8. The upper side of the breech cover part 138 of this cartridge body 140 is provided adjoining the upper side of the magazine strip. Adjoining the casing body 142 is the casing body flange 144, in whose section lies the cover flange 146, designed as a tapering edge section of the breech cover part 138. The flange 144 extends at an angle of approximately 50° to 60° to the longitudinal axis 29 of the cartridge body 140, with the outer surface of the flange 144 and the outer surface of the flange 146 (upper side of the breech cover part 138) extending at an angle to one another. The conical flange 148 of the cartridge body 140 is located in this region. The tapered gap formed in this manner is flat in comparison to those previously described.

A final embodiment of the design of the conical flange of the cartridge body is described with reference to FIGS. 10 and 11, by means of this embodiment it is described how the tapered gap effect can be increased by pre-stressing the conical flange. As with the embodiments according to FIGS. 1 to 6, in the cartridge body 150, the conical flange 152 also extends backwards over the end of the cartridge body 150 on the cover side, representing an extension of the wall of the casing body 154 as it were. The flange 152 of the cartridge body 150 is composed of a flange 156 of the casing body 154 and of a flange 158 of the breech cover part 160. The bottom of the breech 96 again has a projecting region 162, with which it projects into the indentation delimited by the cover flange 158 when the breech is closed. It lies moreover with its side surfaces 164 against the inner surface 166 of the flange 158. The front side 168 of the projecting part 162 of the bottom of the breech 96 facing the breech cover part 160 is arranged at a distance from the breech cover part 160 if the surfaces 164 and 66 touch (see FIG. 10). When the propellent charge explodes in the cartridge body 150, a force acts on the breech cover part 160 which presses the breech cover part 160 against the bottom of the breech 96. However, at the same time, there is an increase in the pre-stressing of the flanges 158 and 156 resulting in a further increase of the tapered gap effect, which of course exists in this region on account of the extending conically flange 152, consisting of the flanges 156 and 158. Through the design of the firing device and the cartridge according to FIG. 10, whereby a gap which remains free is formed between the breech cover part 160 and the projecting part 162 of the bottom of the breech 96 when the device's breech is closed, the tapered gap effect can therefore be further increased in the region of the flange 156. The sense and purpose of the locating surfaces between the breech cover part 160 and the casing body 144, extending parallel to one another and concentrically about the longitudinal axis 29 of the cartridge body 150, is now explained for the embodiment of the cartridge body 150 with reference to FIG. 11. If, in fact, the locating surfaces 170, 172 extend in the direction of the longitudinal axis 29 of the cartridge body 150, the breech cover part 160 and casing body 154 remain in gas-tight contact with one another, even if the breech cover part 160 is raised from the casing body 154 on account of the internal gas pressure being produced inside the cartridge body 150. This can occur, for example, if the cartridge is ignited although the device's breech has not yet been closed. However, it can be seen from FIG. 11 that the space between the cartridge recess 94 and the projecting part 162 of the bottom 96 of the breech is not significantly increased if the device's breech is not completely closed. This is due to the alignment of the flange 152, which extends at an angle of a few degrees, preferentially around 10°, to the longitudinal axis 29 of the cartridge body 150.

What is claimed is:

1. A plastic cartridge for a firing device having a cartridge recess and a breech forming a tapered gap therebetween, which comprises:

a cartridge body having a flange, said body comprising a plastic casing body, open at one end, for accommodating a propellent charge and an ignition charge for igniting the propellent charge and a plastic cover for closing the open end of the casing body, with the flange being located at the open end of the casing body; wherein the flange of the cartridge body tapers in a propagation direction of a pressure wave arising on ignition of the propellant charge in that section in which the flange extends in the propagation direction, at least over a part of said section of the flange, and wherein said flange fits within the tapered gap whereby the tapered gap is sealed during ignition of the propellant charge.

2. A cartridge according to claim 1, wherein the flange of the cartridge body is formed, at least in two parts, one part being from a flange of the casing body and another part being from a flange of the cover at closing of the casing body with the cover, said flanges together forming, at least partly, the tapering section of the cartridge body flange.

3. A cartridge according to claim 1, wherein the flange of the cartridge body extends beyond the open end at an acute angle to a longitudinal axis of the cartridge body.

4. A cartridge according to claim 1, wherein the flange of the cartridge body is bent downwardly, starting from the end of the cartridge body and has an angled down section in which it tapers at least over a part of said section.

5. A cartridge according to claim 1, wherein the flange of the cartridge body extends at the tapering section at an angle of 5° to 15°, to the longitudinal axis of the cartridge body.

6. A cartridge according to claim 1, wherein the flange of the cartridge body extends substantially radially outwards and upwards from the open end of the casing body.

7. A cartridge according to claim 6, wherein the cover, when in the close state in which it is inserted into the open end of the casing body, lies with an outer contact surface against an inner contact surface of the casing body and the inner and outer contact surfaces extend parallel and concentrically to the longitudinal axis of the cartridge body.

8. A cartridge according to claim 7, wherein the cover is lockably engaged with the casing body.

9. A cartridge according to claim 8, wherein the flange of the cartridge body comprises a flange of the casing body and a flange of the cover fitted together and forming at least a portion of the tapering section of the flange of the cartridge body, the flange of the cover and the flange of the casing body being lockably engaged with one another.

* * * * *